US005303441A

United States Patent [19]

Dawson et al.

[11] Patent Number: 5,303,441

[45] Date of Patent: Apr. 19, 1994

[54] METHOD AND APPARATUS FOR DELIVERING METERED QUANTITIES OF FLUID

[75] Inventors: Timothy L. Dawson, Stockport; Henry Ellis, Macclesfield, both of Great Britain

[73] Assignee: Dawson Ellis Limited, Manchester, Great Britain

[21] Appl. No.: 856,952

[22] PCT Filed: Nov. 16, 1990

[86] PCT No.: PCT/GB90/01774

§ 371 Date: Jul. 17, 1992

§ 102(e) Date: Jul. 17, 1992

[87] PCT Pub. No.: WO91/07536

PCT Pub. Date: May 30, 1991

[30] Foreign Application Priority Data

Nov. 18, 1989 [GB] United Kingdom ..... 8926111

[51] Int. Cl.[5] ..... D06B 1/02

[52] U.S. Cl. ..... 8/151; 8/158; 68/205 R; 118/314; 239/101; 239/562

[58] Field of Search ..... 68/205 R; 8/151, 158; 239/86, 101, 562, 708; 118/314, 315

[56] References Cited

U.S. PATENT DOCUMENTS

| | | | |
|---|---|---|---|
| 2,218,811 | 10/1940 | Chaussabel . | |
| 3,393,411 | 7/1968 | McElveen . | |
| 3,560,641 | 2/1971 | Taylor et al. | 118/314 X |
| 3,730,133 | 5/1973 | Cordiano et al. | 118/314 X |
| 3,875,893 | 4/1975 | Riley et al. | 118/315 X |
| 4,033,154 | 7/1977 | Johnson . | |
| 4,141,231 | 2/1979 | Kudlich . | |
| 4,170,883 | 10/1979 | Varner . | |
| 4,294,406 | 10/1981 | Pevnick | 239/562 X |
| 4,485,508 | 12/1984 | Otting . | |
| 4,501,038 | 2/1985 | Otting . | |
| 4,687,137 | 8/1987 | Boger et al. | 239/562 X |
| 4,698,642 | 10/1987 | Gamblin | 68/205 R X |
| 4,736,209 | 4/1988 | Glenn et al. | 239/708 X |
| 4,844,004 | 7/1989 | Hadzimihalis et al. | 118/315 |
| 4,877,188 | 10/1989 | Ritter | 239/562 X |

FOREIGN PATENT DOCUMENTS

| | | |
|---|---|---|
| 0057513 | 8/1982 | European Pat. Off. . |
| 123367 | 10/1984 | European Pat. Off. . |
| 3002505 | 7/1980 | Fed. Rep. of Germany . |
| 8101161 | 4/1981 | PCT Int'l Appl. . |
| 1202345 | 8/1970 | United Kingdom . |
| 1431264 | 4/1976 | United Kingdom . |
| 1447129 | 8/1976 | United Kingdom . |
| 2022017 | 12/1979 | United Kingdom . |
| 2042422 | 9/1980 | United Kingdom . |

*Primary Examiner*—Philip R. Coe

*Attorney, Agent, or Firm*—Oblon, Spivak, McClelland, Maier & Neustadt

[57] ABSTRACT

Method and apparatus for jet printing, e.g. of textile fabrics, are disclosed. Metered quantities of fluid, e.g. dye, are supplied in a succession of discrete small quantities through capillaries in boards which can be angled relatively to a moving fabric for fineness of spacing. Multiple boards extend across the fabric path and the capillaries pass the dye on computer command to print any desired pattern. Each row of boards can replace a conventional printing screen in a multicolour printing machine.

20 Claims, 6 Drawing Sheets

METHOD AND APPARATUS FOR DELIVERING METERED QUANTITIES OF FLUID

TECHNICAL FIELD

This invention relates to methods and apparatus for delivering metered quantities of fluid.

BACKGROUND ART

In EP-A1-0,306,568 are disclosed a method and apparatus for applying liquid medium to web or sheet material, particularly for patterning material such as woven or tufted web material such as carpet fabric and tiles. The apparatus comprises a row of jets each of which is controlled by an electro-mechanical valve. The material is passed beneath the jets which fire discrete liquid droplets directly at the material when the valves open and close under the control of a computer. Several such rows can be provided to apply multiple colours.

The jets comprise hollow needles or capillary tubes which have a bore diameter of from 0.2 mm to 2 mm and operate to fire the liquid in pulses of 0.5 to 15 milliseconds, the duration being varied to match other parameters such as the pressure of the liquid and its viscosity, the speed of passage of the material and the extent of the area desired to be covered by each pulse.

While the apparatus as is described in EP-A1-0,306,568 is eminently suitable for the printing of patterns such as are appropriate to carpets and carpet tiles and at reasonable speeds in comparison to other, conventional ways of patterning such items, it is not readily capable of being adapted to printing fine detail such as is required on apparel fabrics and some household fabrics for curtains, upholstery and the like, nor to operate at speeds commensurate with conventional methods for colouring such fabrics.

DISCLOSURE OF THE INVENTION

The present invention provides methods and an apparatus by which such apparatus may be so adapted.

The invention comprises a method for delivering metered quantities of fluid comprising supplying the fluid under pressure to a valve with a capillary outlet having a valve end and a delivery end and controlling the opening and closing of the valve to admit a succession of discrete quantities of the fluid to the valve end whereby to expel a like succession from the delivery end the valve being opened only for a time interval within the range of time intervals for which the amount of fluid admitted to and hence the amount expelled from the capillary outlet is linearly dependent on the time interval.

The invention also comprises a method for delivering metered quantities of fluid from a plurality of capillary outlets which may have different characteristics comprising supplying the fluid under pressure to valves for said capillary outlets which each have a valve end and a delivery end and controlling the opening and closing of the valves to admit successions of discrete quantities of fluid to the valve ends whereby to expel like successions from the delivery ends the valves being opened only for time intervals for which the amount of fluid admitted to and hence the amount expelled from the capillary outlet is independent of the characteristics of the capillary outlets.

Said discrete quantities may be from 0.01 to 0.05 microliters in volume.

The invention also comprises a method for applying fluid such as colorant to a web material comprising metering quantitites of the fluid through a plurality of valved capillary outlets in the aforesaid way. Said outlets may be spaced apart so as to be able to apply the fluid to the web in lines spaced 30/cm. The outlets may be arranged in echelon with regard to a relatively travelling web so as to space the lines of application of the fluid to the web more closely than the spacing between adjacent outlets.

The invention also comprises a method for applying fluid such as fluid to a textile web, comprising applying the colourant in droplets of volume 0.01 to 0.05 microliters selectively from outlets so arranged and controlled as to apply the droplets at a possible packing density of 1,000,000 droplets per square meters.

The succession of discrete quantities may be at the rate of between 2,500 and 4,000 per second. The fluid may comprise a liquid of low viscosity.

The invention also comprises apparatus for applying a fluid to a web comprising a supply for liquid under pressure to a plurality of valves with capillary outlets terminating in a row and means for relatively travelling the web and said row of outlets arranged at an angle to the direction of relative travel so as to apply the fluid to the web more closely than the spacing between adjacent outlets.

In another aspect, the invention comprises an apparatus for applying a liquid to a web comprising a board with capillary outlets arranged along one edge connected to an inlet through valves carried on the board. Said board may be of laminated construction, the capillary outlets being formed by grooves between facing members. The construction may be generally symmetrical about a central plane and provide two rows of outlets in said one edge. The valves may be electrically operated and carried on a printed circuit board. The valves may comprise plungers or diaphragms.

The board may be adapted for ready removal from and replacement in a support for mounting the same adjacent a relatively moving web.

The board may have an inlet manifold for the fluid and may mount the valves between the manifold and the outlets. The valves may be arranged in groups on branches of the manifold, and may be arranged in groups of four each group being of square configuration and the valves being held to the board by an end cap covering the group and secured to the board by a central fastener. The board may be double sided, the inlet manifold being central and valves are located on opposite faces.

The apparatus may comprise control means controlling the operation of the valves and may comprise a driver for each valve having "0" and "1" logic states and valve selector means assigning logic states to the drivers, and firing means transmitting a firing signal to all the valves on the board simultaneously, those valves with their drivers in the "1" logic state firing, those with their driver in the "0" logic state not firing on receipt of the signal.

The valve drivers may be connected to the valve selector means by opto-isolators.

The apparatus may comprise, for each row of capillary outlets, a board containing said row of outlets and valve and valve driver means therefor, and a board processing unit for said board including said valve selector means. Said processing unit may comprise a transputer.

A primary arrangement to cover any normally useful width will have a plurality of such boards and comprise a controlling computer assigning pattern instructions to the board processing units.

BRIEF DESCRIPTION OF THE DRAWINGS

Embodiments of apparatus and methods for delivering metered quantities of fluid according to the invention will now be described with reference to the accompanying drawings, in which.

BEST MODE FOR CARRYING OUT THE INVENTION

Figure 2:
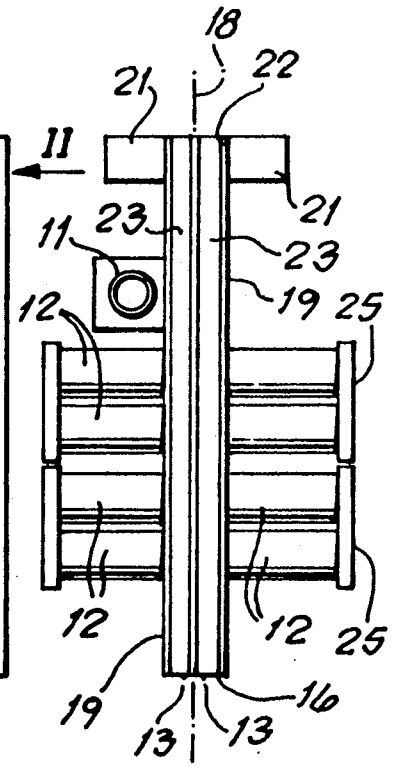
FIG. 2 is a view in the direction of Arrow II of FIG. 1.

The apparatus illustrated in FIGS. 1 to 6 comprises a supply 11 for a liquid under pressure to a plurality of valves 12 with capillary outlets 13 terminating in a row and means 14 (FIG. 6) for travelling a web 15 past said row of outlets 13. The row of outlets 13 is arranged at an angle to the direction of web travel so as to apply the liquid to the web more closely than the spacing "S" between adjacent outlets 13 (see FIG. 1).

The outlets 13 are arranged along one edge 16 of a board 17. The valves 12 are carried on the board 17, which is of laminated construction, the capillary outlets 13 being formed by grooves between facing members. The board construction is symmetrical about a central plane 18 (FIGS. 2–4) and provides two rows of outlets 13 along said edge 16.

The valves 12 are electrically operated and are carried on printed circuit boards 19 which form the outer layers of the laminate and carry printed circuitry connecting the valves 12 to connectors 21 on the edge 22 of the board opposite the edge 16.

Figure 1:
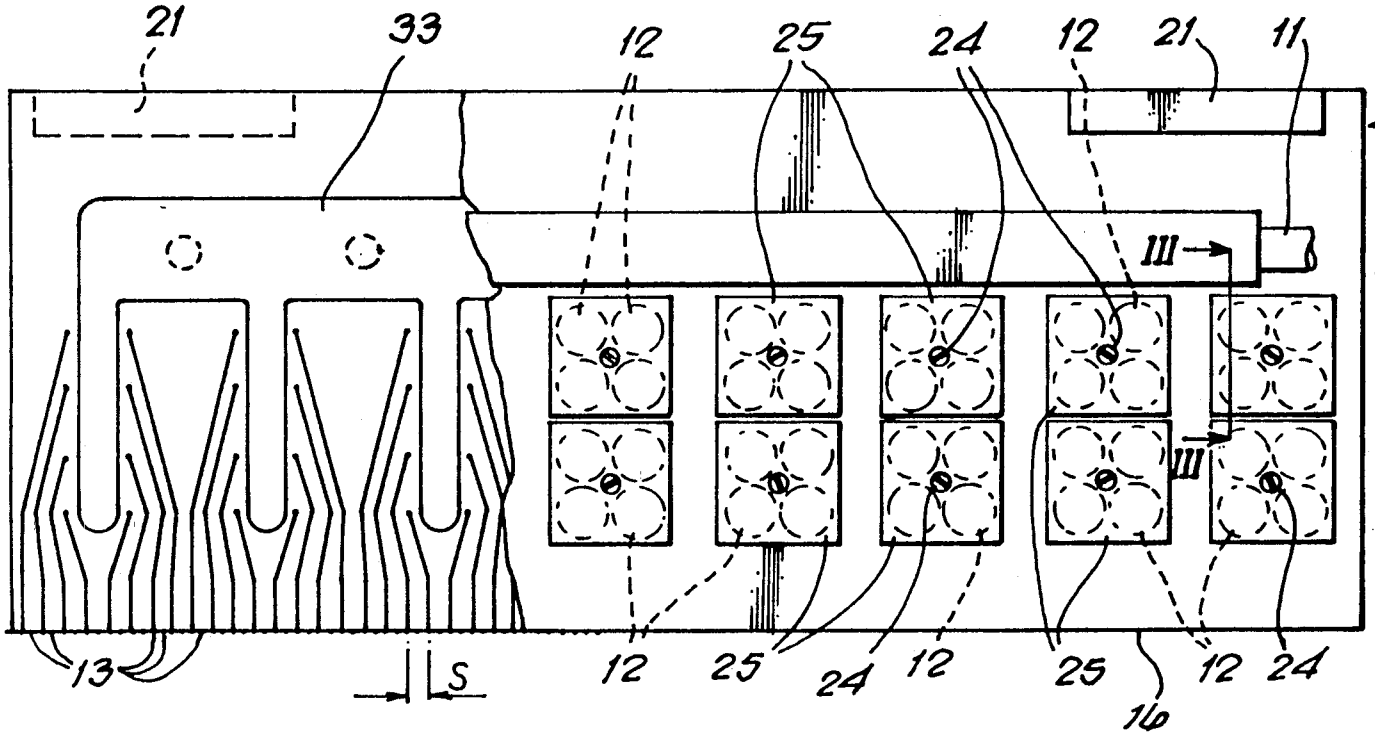
FIG. 1 is a partially cut-away elevational view of one form of the apparatus.
Figure 3:
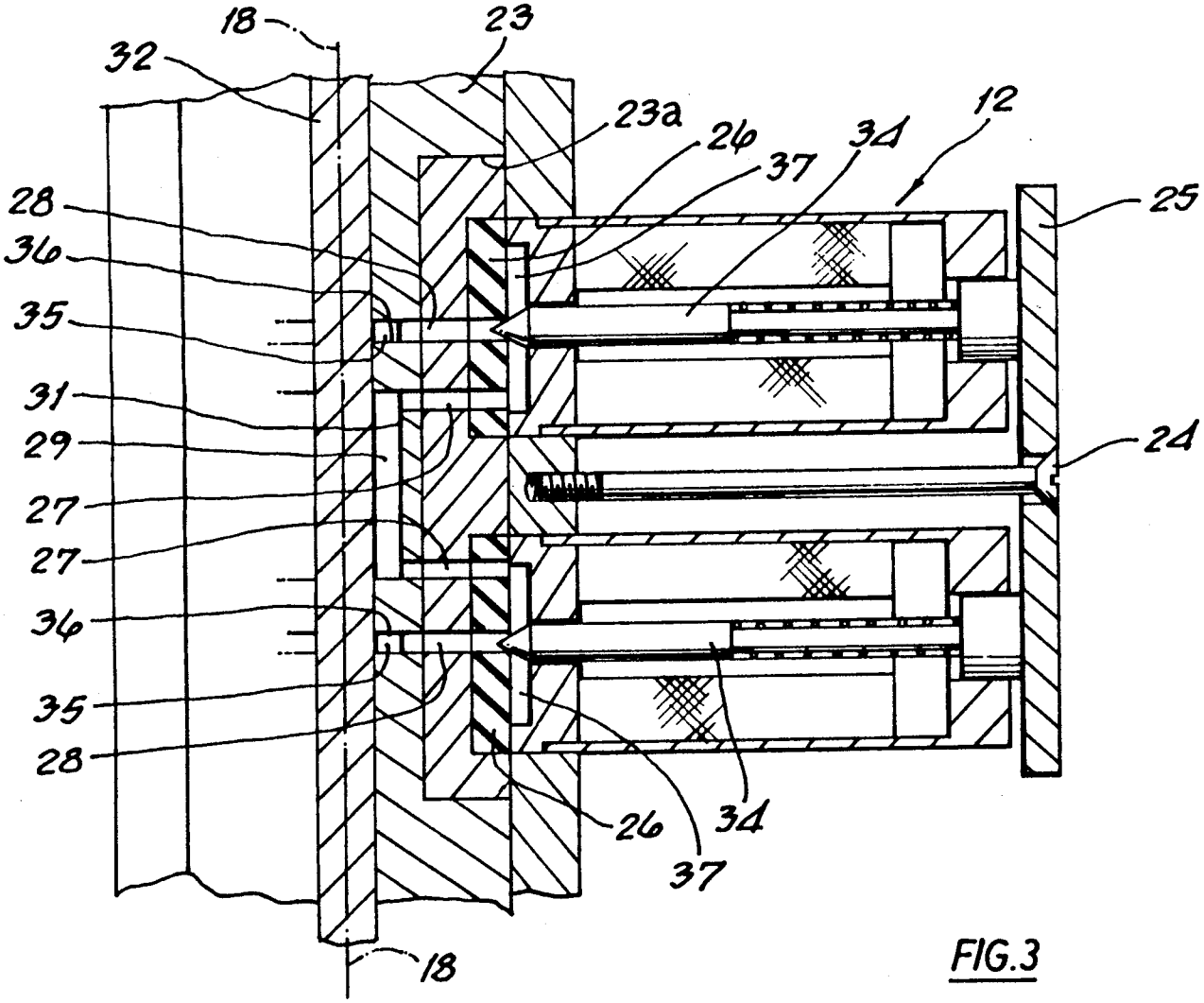
FIG. 3 is a partly sectional view taken along line III—III of FIG. 1 but on an enlarged scale.

The printed circuit boards 19, in the embodiment illustrated in FIGS. 1 to 3, lie against synthetic material plates 23 which have recesses 23*a* at the positions of the valves 12 which are secured thereto by screws 24 located centrally of caps 25, each cap 25 covering a group of four valves. On each side of the board 17 are arranged sixty four valves 12. The connectors 21 are 65-pin connectors, for 64 control lines and a common return.

The valves 12 are seated on inserts 26, e.g. of elastomeric rubber, which have inlet and outlet apertures 27,28 respectively of which inlet aperture 27 is connected to a channel 29 formed by a shallow groove 31 in the plate 23 which lies against a central aluminium plate 32 of the laminate. The channel 29 is connected to the supply 11 via an inlet manifold 33 at the edge 22 of the board 17.

Figure 5:
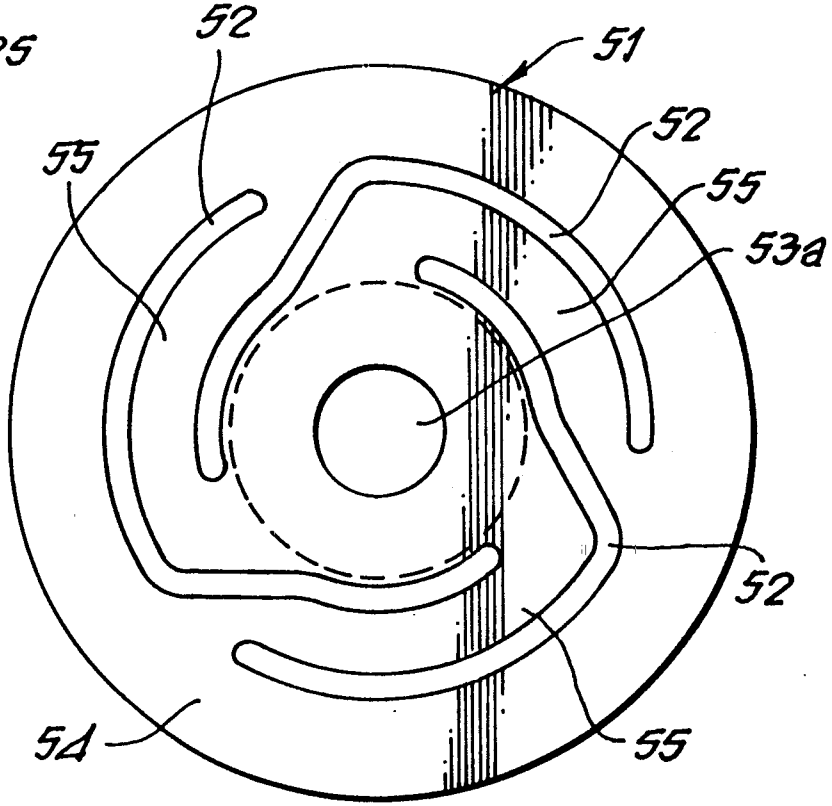
FIG. 5 is a face-on view of a diaphragm for the valve of FIG. 4.
Figure 4:
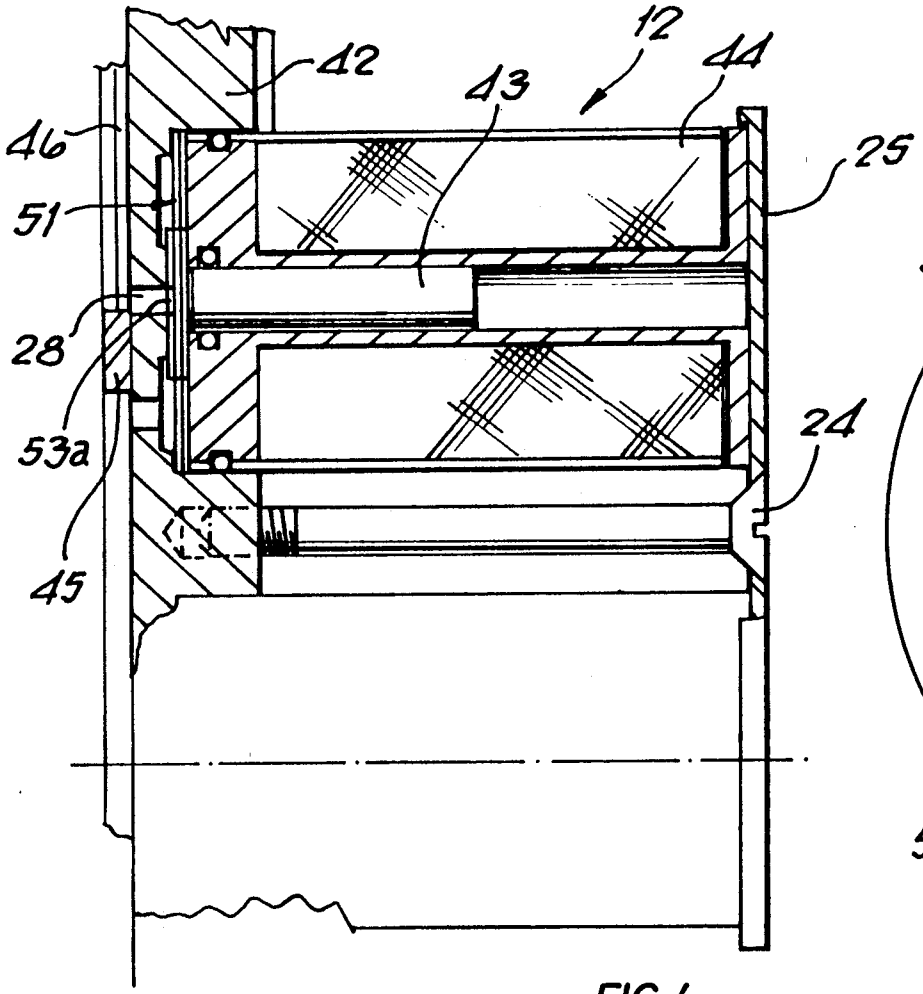
FIG. 4 is a sectional view like FIG. 3 showing a detail of an alternative valve assembly.

The outlet aperture 28, which is central of the insert 26, is normally closed by the plunger 34 of the valve 12 and opens into a capillary channel 35 formed by a groove 36 against the central plate 32. The replaceable elastomeric seating of the valve 12 on the insert 26 is such as to leave an annular space 37 which, when the plunger 34 is lifted from its seat in the outlet aperture 28, connects the two apertures so that the pressurized liquid supply is connected to the capillary outlet FIGS. 4 and 5 illustrate a different construction in which a diaphragm valve is used, the diaphragm 51 being shown face-on in FIG. 5 and comprising a disc with slots 52 leaving a central portion 53 connected to the outer ring portion 54 by flexible spokes 55. The central portion 53 normally closes an outlet aperture 28 in a valve-receiving recess 41 of an aluminium plate 42 and is loaded thereagainst to be lifted therefrom by an iron plunger 43 when the solenoid 44 is energised. The aluminium plate 42 has a flat surface away from the valve side which lies against an etched nickel plate 45 central to the laminated assembly affording the capillary outlets by channels 46.

Valves of either of the types described can be made to operate at very high speeds up to for example 6000 Hz with durability to enable one billion cycles per week and 2 to 3 year usage. By way of example, the total flexing movement of the central part 53 of the diaphragm 51 can be 0.12 mm.

The capillary outlets, as formed by the channels 35 (FIG. 3) and 46 are typically of a cross-section of or tapering down to about 0.1 $mm^2$ and terminate in a hollow needle insert of substantially smaller internal cross-section, though if the capillaries taper to a smaller cross-section, needle inserts may be dispensed with. Such narrow passageways, especially with liquids such as are commonly used in textile printing which may comprise pigment pastes and have significant viscosity and frictional interaction with the passageway walls, impart substantial resistance to the flow of liquid. The construction necessarily implies that the passageways will have different lengths and hence different degrees of resistance to flow.

If, in order to draw two solid lines on a relatively moving fabric, two of the capillary outlets were continuously supplied with liquid by their respective valves being held open, and if one of the outlets was substantially longer than the other, the result would be that it would draw a fainter line, because the increased resistance would result in a reduced flow.

It is found, however, that for a given supply pressure, a given configuration of capillary outlets and given liquid characteristics, there is a range of valve opening durations which results in the delivery from the capillary outlet being linear with regard to the opening duration over the range and in particular being independent of the length of the capillary outlet.

Thus operating the valves by brief pulses to admit pressured liquid to the capillary outlets for these brief periods only will result in each outlet delivering precisely the same amount of liquid per pulse regardless of the length of the outlet from the valve end to the outlet end.

The arrangement, with the high-frequency valves, is therefore capable not only of fine resolution laterally and lengthwise of the relatively travelling web, but is also capable of delivering the liquid in a very regular fashion regardless of the position of the outlet end of the capillary with regard to the valve.

Provided that the duration of each pulse is within the range for which delivery is linear with duration, it is possible to effect control of delivery by altering the pulse duration. However, from a control point of view it is simpler to arrange that the pulses are of equal duration and to control delivery by controlling the pulse rate. It is necessary that the pulses should be so close together in time that consecutive pulses leave no gap between the liquid droplets as they cover the web surface or, conversely, that at the chosen maximum pulse frequency, the droplets affect contiguous areas of the web.

With the illustrated arrangements it is possible to arrange the droplet tracks correspondingly close together so that adjacent tracks leave no gap in the liquid application to the web and with the fine effective spacing made possible by the echelon arrangement together with the rate of pulsing attainable it is readily possible to emulate an 80-mesh screen in fineness of print detail attainable. The echelon arrangement increases the accuracy of spacing between droplet tracks, as any errors in construction are reduced by a considerable factor because of the angling of the boards, especially at high degrees of echelon, that is to say very acute angles between the edges of the boards and the direction of travel.

Figure 6:
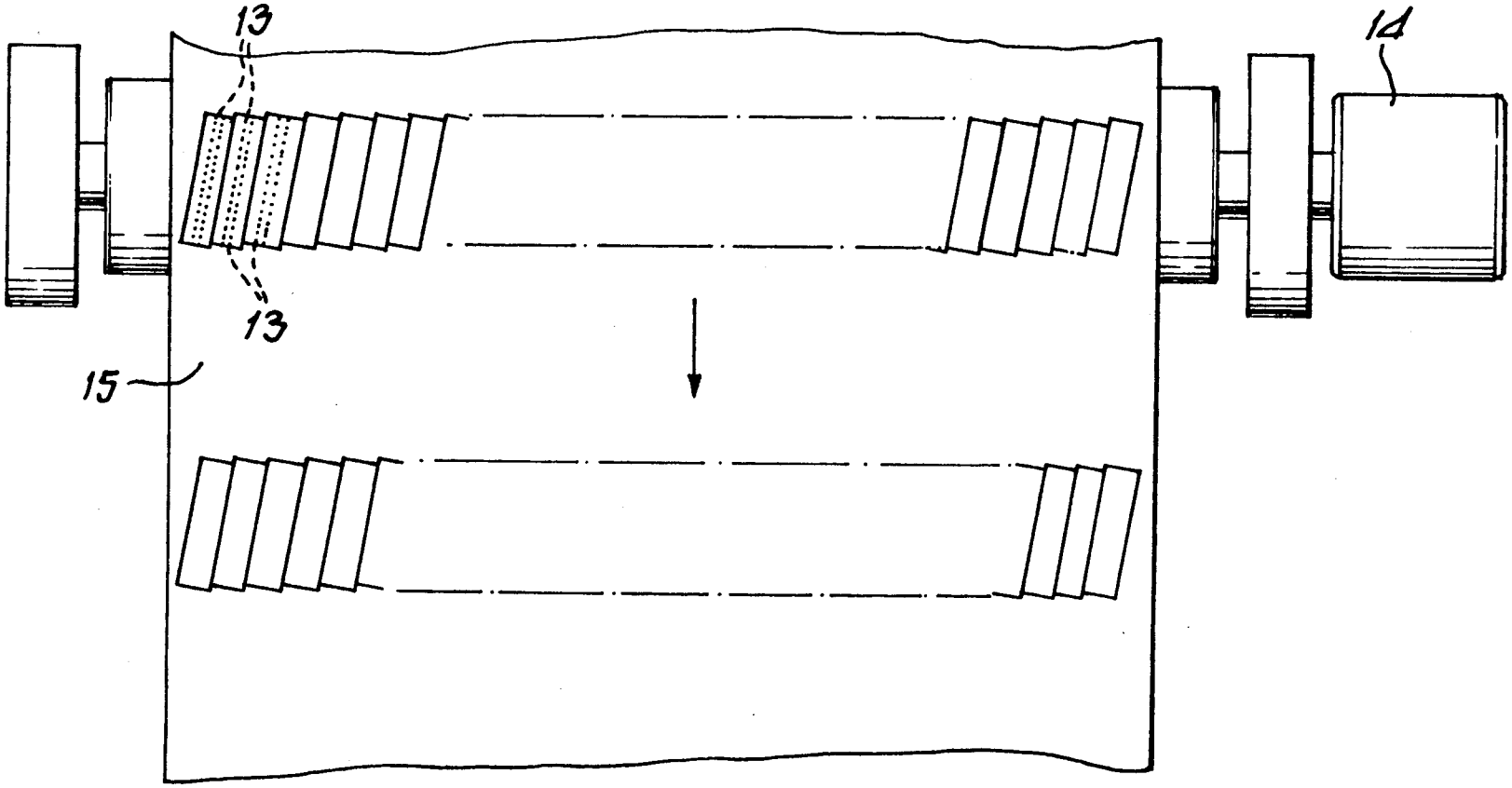
FIG. 6 is a plan view of part of a web printing arrangement.

On a double-sided board 269 mm long by 40 mm wide (over the caps for the valves) it is possible, for example, to arrange 128 capillary outlets in two rows. By arranging seventy five of these boards side-by-side each aligned at 8° 50′ to the direction of web travel as illustrated in FIG. 6 it is possible to cover the width of a three meter fabric with 9600 outlets.

Such an arrangement is equivalent to a single printing screen and occupies substantially the same space as a rotary screen and so could be fitted to an existing screen printing machine in place of the screen. A print machine may comprise as many such arrangements as there are colours to be printed.

A normal repeat design pattern will have 4 to 5 million dots shared among various colors (from 2 to 24), and the rate of dot production will be up to 4,000 dots/-second. A control arrangement for superfast parallel feeding of instructions to the valves is provided.

Figure 7:
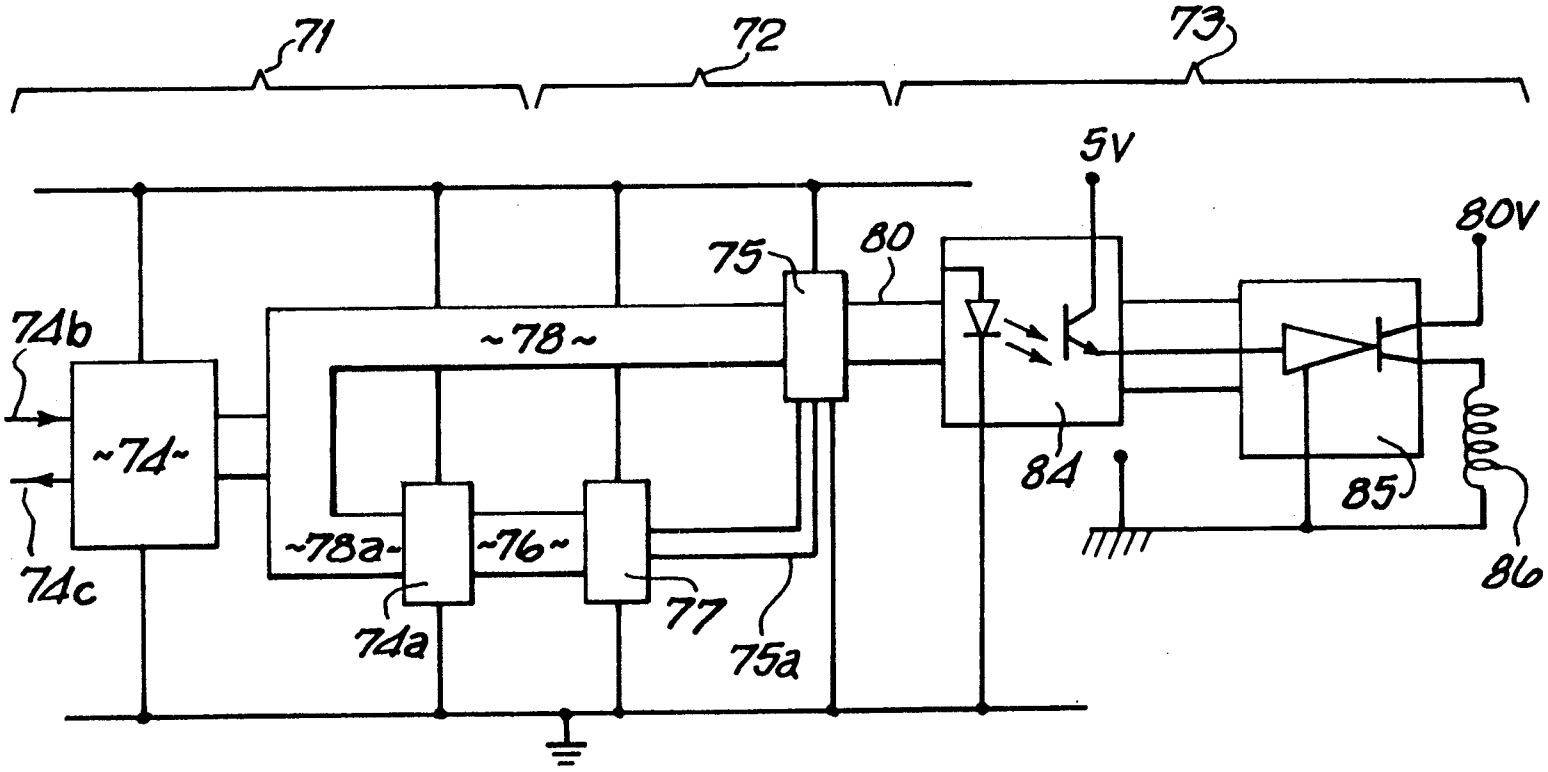
FIG. 7 is a schemetic diagram of a control arrangement.

The control arrangement for each board (FIG. 7) comprises a single board central processing unit (CPU) 71, a transistor transistor logic (TTL) latch board 72 and a valve driver board 73.

The CPU 71 comprises a transputer based single board computer 74, with ROM and RAM, providing address bus 76 with address latch 74*a*, data bus 78 and input/output control signal paths 74*b*,74*c*. The purpose of the central processing unit 71 is to control the timing and sequence of the firing of the valves for one colourway. The pattern is downloaded from a standard computer, along with commands such as start, stop, etc. To get an 80 mesh spacing in the length direction, the time interval between firings is arranged to be dependent on the speed of the moving cloth. One method of timing control is to feed signals from a tachometer (shaft encoder) attached to the drive belt.

When the pattern is downloaded it is stored on the CPU's ram and if necessary also on memory expansion boards (now shown).

Figure 8:
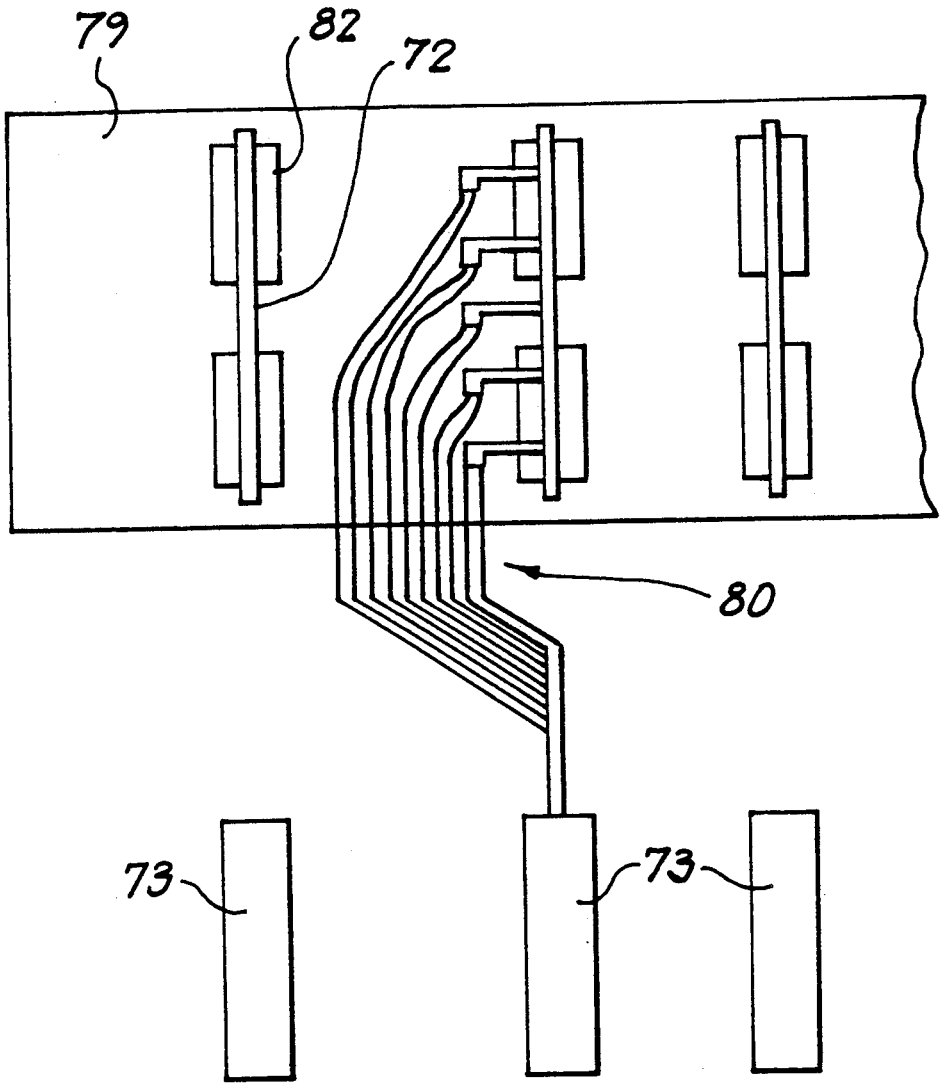
FIG. 8 is a board connection arrangement.

Each TTL latch board 72 has an onboard address decoding chip 77 and is connected to the CPU via a P.C.B. backplane 79 (FIG. 8) and backplane connectors 82 with a 32 bit address bus 76, a 32 bit data bus 78 and a control signals bus 78*a*. Each latch board 72 is connected to a valve driver board 73 via five 34 way ribbon cables 80, each carrying 32 bits data and two power lines.

The valve driver board 73 comprises an optoisolator 84, a Darlington driver 85 and a valve coil 86 for each valve on the board 17.

A valve is turned on/off by applying a (TTL) level signal to the base of the "open collector" Darlington transistor driver 85, capable of switching 80 V at 0.3 amps to the coil of the valve 86. For a two meter width at 80 mesh there are 6300 valves. The width of the databus 78 of the transputer 74 is 32 bits, so that when all the valves are fired simultaneously the firing information for each valve (1 bit) is multiplexed out to each valve, in packets of 32 at a time. It is held (latched), disabled, until all the valves have their information latched and the correct firing time has arrived. At this time the enabling signal is output to all latches 75, and each Darlington driver 85 will either switch on its coil 86 or remain inactive depending on the logic level of the latch 75.

The latch 75 and preceding circuitry on the one hand and the Darlington driver 85 on the other have separate power supplies. The valve coils 86, if fired all at once, could consume nearly 2,000 amps at 80 volts at more than 1.5 kHz.

Thus a separate latch chip 75 is used which outputs to an opto-isolator chip 84 which in turn outputs to the Darlington driver 85. Each latch board holds sixteen octal latch I.C.'s feeding 128 drivers. Each valve board driver 73 contains 32 quad Darlington driver I.C.'s 85 and 32 quad opto-isolator I.C.'s 84.

To apply a dye pattern to a fabric at 80 mesh spacing, the opening and closing of the valves is changed as the fabric moves forward.

This is controlled by a master control computer and separate controllers for each colourway. The function of the control computer is to issue commands and download patterns to each colourway controller. The software running on the control computer is the "human interface" program and the pattern translation programs. The human interface program allows operators to load patterns, start, stop, halt printing etc. The pattern translation programs take patter designs contained in either a composite file or separate colour files and translate them into a bit pattern file for each colourway. The first part of the translation process separates a pattern into a spatial bit pattern for each colour. The second part transforms this into a firing sequence pattern to take into account the fact that the valves are not organized in a straight line across the fabric. As long as the protocol is known any data source can be operated upon by the first part of the translation software e.g. a color scanner may input a scan of a photograph, painting, document etc. The control computer may also be used to log errors and perform fault diagnosis. The separate spatial bit patterns for each color may also be used by a relatively simple image analysis system to compare the finished dyed cloth with the original pattern as a quality control measure and also to isolate any faulty valves.

Major advantages over conventional screen and roller printing are that patterns and colours may be changed by changing the programming without any need to stop the machinery, and so the efficiency of the machinery is very substantially increased (from 30–50% efficiency with conventional machines to around 95% with the present invention), as is the facility to produce short pattern runs e.g. for sampling without interfering with long-run production.

Since the amount of liquid stock in the system is very small, color changes can be effected easily and rapdily with low washing-through water utilization and very much reduced waste and effluent.

We claim:

1. A method for delivering metered quantities of fluid, comprising:

supplying the fluid under pressure to a valve with a capillary outlet having a valve end and a delivery end, and controlling the opening and closing of the valve to admit a succession of discrete quantities of the fluid to the valve end and to expel a like succession from the delivery end, such that the amount fluid admitted to and the amount of fluid expelled from the capillary outlet is linearly dependent on a time interval for which the valve remains open.

2. A method according to claim 1, characterised in that said discrete quantities are from 0.01 to 0.05 microliters in volume.

3. A method according to claim 1, characterised in that the succession of discrete quantities is at the rate of between 2,500 and 4,000 per second.

4. A method according to claim 1, characterised in that the fluid comprises a liquid of low viscosity.

5. A method for delivering metered quantities of fluid from a plurality of capillary outlets, comprising:

supplying the fluid under pressure to valves for said capillary outlets which outlets each have a valve end and a delivery end, and controlling the opening and closing of the valves to admit successions of discrete quantities of fluid to the valve ends whereby to expel like successions from the delivery ends, such that the amount of fluid admitted to and the amount of fluid expelled from the capillary outlet is linearly dependent on a time interval for which the valve remains open.

6. A method according to claim 5, for applying fluid to a textile web material, comprising delivering metered quantities of the fluid through a plurality of said valved capillary outlets.

7. A method according to claim 6, which comprises spacing said outlets apart so as to be able to apply the fluid to the web in lines spaced 30/cm.

8. A method according to claim 4 which comprises arranging the outlets in echelon with regard to a relatively travelling web so as to space the lines of application of the fluid to the web more closely than the spacing between adjacent outlets.

9. A method for applying fluid to a textile web, which comprises applying the fluid in droplets of a volume of 0.01 to 0.05 microliters selectively from outlets so arranged and controlled as to apply the droplets at a packing density of 1,000 droplets per square meter.

10. Apparatus for delivering metered quantities of fluid, comprising:

a pressure supply for supplying the fluid under pressure, a valve with a capillary outlet having a valve end and delivery end, and a mechanism for controlling the opening and closing of the valve to admit a succession of discrete quantities of the fluid to the valve end whereby to expel a like succession from the delivery end, wherein the amount of fluid admitted to and the amount of fluid expelled from the capillary outlet is linearly dependent only on a time interval for which the valve remains open.

11. Apparatus for delivering metered quantities of fluid from a plurality of capillary outlets, comprising:

a pressure supply for supplying the fluid under pressure, a plurality of valves each with a capillary outlet having a valve end and a delivery end, and a mechanism for controlling the opening and closing of the valves to admit successions of discrete quantities of the fluid to the valve ends whereby to expel like successions from the delivery ends, wherein the amount of fluid admitted to and the amount of fluid expelled from the capillary outlet is linearly dependent only on a time interval for which the valve remains open.

12. Apparatus according to one of claims 10 or 11, comprising a driver for each valve having "0" and "1" logic states and a valve selector assigning logic states to the drivers, and a firing device for transmitting a firing signal to all of the valves simultaneously, those valves with their driver in the "1" logic state firing, and those with their driver in the "0" state not firing on receipt of the firing signal.

13. Apparatus according to claim 12, characterised in that the valve drivers are connected to the valve selector means by opto-isolators.

14. Apparatus according to one of claims 10 or 11, comprising a board containing said row of outlets and valve and a valve driver therefor.

15. Apparatus according to claim 14, comprising multiple boards and a controlling computer assigning pattern instructions to the board processing units.

16. Apparatus for applying a liquid to a web, comprising:

a board having an edge and being of a laminated construction comprising two members facing each other and laminated together, a liquid inlet to the board, a plurality of valves carried on the board, a plurality of capillary outlets arranged along said edge and connected to said inlet through said valves, the capillary outlets being formed by grooves between said facing members, and the construction being generally symmetrical about a central plane and providing two rows of outlets in said edge.

17. Apparatus for applying a liquid to a web, comprising:

a board having an edge, a fluid inlet to the board, a plurality of valves carried on the board, a plurality of capillary outlets arranged along said edge and connected through said valves to said inlet, wherein the board comprises a printed circuit board and the valves are electrically operable.

18. Apparatus for applying a liquid to a web, comprising:

a board having an edge and being of a laminated construction comprising two members facing each other and laminated together, a liquid inlet to the board, a plurality of valves carried on the board, a plurality of capillary outlets arranged along said edge and connected to said inlet through said valves and being formed by grooves between said facing members, wherein the board comprises a printed circuit board and the valves are electrically operable.

19. Apparatus for applying a liquid to a web, comprising:

a board having an edge, a liquid inlet to the board, a plurality of valves carried on the board, two rows of capillary outlets arranged along said edge and connected to said inlet through said valves, wherein said valves are electrically operable and the board comprises a circuit board.

20. Apparatus for applying a fluid to a web, comprising:

a plurality of valves with capillary outlets terminating in a row, a supply for liquid under pressure to said plurality of valves, and a mechanism for relatively traveling the web and said row of outlets arranged at an angle to the direction of travel so as to apply the fluid to the web more closely than the spacing between adjacent outlets.

* * * * *